United States Patent [19]

Kondoh

[11] 4,350,432

[45] Sep. 21, 1982

[54] DEVELOPMENT APPARATUS FOR DEVELOPING LATENT ELECTROSTATIC IMAGES

[75] Inventor: Shiroh Kondoh, Sagamihara, Japan

[73] Assignee: Ricoh Company Ltd., Tokyo, Japan

[21] Appl. No.: 102,782

[22] Filed: Dec. 12, 1979

[30] Foreign Application Priority Data

Feb. 21, 1979 [JP] Japan ..... 54-19450

[51] Int. Cl.[3] ..... G03G 21/00

[52] U.S. Cl. ..... 355/3 DD; 118/658; 430/122

[58] Field of Search ..... 355/3 DD; 118/656, 657, 118/658; 430/122, 125

[56] References Cited

U.S. PATENT DOCUMENTS

| | | | |
|---|---|---|---|
| 3,703,395 | 11/1972 | Drexler et al. | 118/658 X |
| 4,081,571 | 3/1978 | Nishihama et al. | 118/657 X |
| 4,096,826 | 6/1978 | Stange | 118/656 |
| 4,101,320 | 7/1978 | Sellers et al. | 355/3 DD X |
| 4,102,306 | 7/1978 | Ohta | 118/658 |
| 4,121,931 | 10/1978 | Nelson | 118/658 X |
| 4,155,638 | 5/1979 | Blitzer | 355/3 DD |
| 4,193,376 | 3/1980 | Hamaguchi et al. | 118/658 |
| 4,235,193 | 11/1980 | Groen et al. | 118/658 |

FOREIGN PATENT DOCUMENTS 2605194 8/1977 Fed. Rep. of Germany ..... 118/658

*Primary Examiner*—J. V. Truhe
*Assistant Examiner*—Richard M. Moose
*Attorney, Agent, or Firm*—Wyatt, Gerber, Shoup, Scobey & Badie

[57] ABSTRACT

A magnetic brush development apparatus for developing latent electrostatic images formed on a flexible latent electrostatic image bearing member by a magnetic brush employing powder developer containing a magnetic material. The latent electrostatic image bearing member is positioned in contact with or in proximity to the magnetic brush formed on a sleeve for development. In a portion where the sleeve and the latent electrostatic image bearing member are positioned in proximity to each other, there are formed two spaces whose cross sections are wedge-shaped and development of the latent image is performed in the space on the upstream side with respect to the transport direction of the latent image bearing member and the unnecessary toner deposited on the latent image bearing member is cleaned in the other space on the downstream side.

15 Claims, 6 Drawing Figures

DEVELOPMENT APPARATUS FOR DEVELOPING LATENT ELECTROSTATIC IMAGES

BACKGROUND OF THE INVENTION

The present invention relates to a dry type development apparatus for developing latent electrostatic images in facsimile apparatus and electrophotographic copying apparatus employing powder developer containing a magnetic material.

As a dry type development apparatus, the so-called magnetic brush development apparatus is known, which comprises a non-magnetic sleeve with internally disposed magnets. In such a development apparatus, a magnetic brush made of a developer containing a magnetic material is formed on the surface of a non-magnetic sleeve and latent electrostatic images are developed by moving the magnetic brush in contact with the latent electrostatic images.

When the latent electrostatic images are developed by the development apparatus of this type, it is required that the gap between the tip of the magnetic brush and a latent image bearing member, and the time the magnetic brush is in contact with the latent image bearing member, be kept constant respectively. Otherwise, the developed visible images may become uneven in image density and the developer may be deposited on the background of the developed images. When the latent electrostatic image bearing member is made of a rigid member such as a photoconductor drum and is rotated at a predetermined speed, comparatively it is not so difficult to prevent the above-mentioned undesirable phenomenon, since the gap between the tip of the magnetic brush and the surface of the photoconductor drum can be maintained nearly constant, for instance, by regulating the height of the magnetic brush by using a doctor blade.

However, in the case of a flexible latent electrostatic image bearing member, such as a recording paper to be used in a signal reception section of facsimile apparatus, it is extremely difficult to maintain the gap between the top of the magnetic brush and the surface of the flexible latent image bearing member constant. Furthermore, in the facsimile apparatus, the transportation speed of the recording paper is not always constant. In other words, the recording paper may be transported continuously or intermittently, depending upon the density of information to be received. Therefore, the time the magnetic brush is in contact with the recording paper may not be constant, and the recording paper may not always be moved in the same direction, either.

More specifically, the time the recording paper in the facsimile apparatus is in contact with the magnetic brush varies. This may cause uneven development of latent electrostatic images, fog of recorded images and smearing of the background of the recording paper.

In order to eliminate the above-mentioned problems, it could be proposed that the magnetic brush be moved in conformity with the movement of the recording paper so that the time the latent electrostatic images and the magnetic brush are in contact with each other is kept constant, or it could be proposed that, after development, the recording paper is cleaned by a cleaning apparatus to remove the developer deposited on the background of the recording paper. The former method, however, cannot be performed easily by use of a conventional magnetic brush apparatus, since a complicated mechanism is required to carry out the method, and the latter method has a disadvantage that the apparatus for performing the methods tends to become oversized and expensive, since it requires a cleaning apparatus in addition to the development apparatus.

In short, in the development apparatus of facsimile apparatus, smearing of the background of the recording paper, fog of recorded images, and uneven development cannot be overcome by simple use of the conventional techniques.

Referring to FIG. 1, there is shown a conventional development apparatus having means for keeping the gap between a flexible latent image bearing member and a non-magnetic sleeve constant. In FIG. 1, reference numeral 1 represents a non-magnetic stationary sleeve. Inside the sleeve 1, there is rotatably disposed a magnetic roller 2, which is alternately magnetized to negative and positive polarity in the circumferential direction of the sleeve 1. The magnetic roller 2 is rotated in the direction of the arrow by a suitable drive means (not shown). Under the sleeve 1, there is disposed a toner container 3 for holding a one-component type magnetic developer T therein. When the magnetic roller 2 is rotated clockwise, the toner T placed in the toner container 3 is moved counterclockwise along the surface of the sleeve 1, so that the toner T attracted magnetically to the surface of the sleeve 1, in the form a brush, is regulated by a doctor blade 4 in a manner such that the height of the brush is constant.

A gap roller 5 is rotatably disposed near the sleeve 1, with a predetermined space therebetween. The gap roller 5 is made of an electrically conductive material. In this development apparatus, the gap roller 5 serves to guide a recording paper 6 of a facsimile transceiver. Latent electrostatic images are formed on the recording paper 6 by a latent electrostatic image formation apparatus 7.

The recording paper 6 is transported in the direction of the arrow by a paper transport apparatus (not shown). During the transportation of the recording paper 6, the toner T on the surface of the sleeve 1 is supplied to the latent electrostatic images formed on the recording paper 6. The gap between the recording paper 6 and the surface of the sleeve 1 is maintained constant by the gap roller 5.

In the development apparatus as shown in FIG. 1, it is required that the distance between the sleeve 1 and the gap roller 5 be maintained small and, at the same time, the sleeve 1 and the gap roller 5 be held axially parallel to each other. However, this is very difficult in practice, since their respective adjustable ranges are narrow and in order to compensate for the narrow adjustable ranges, the accuracy of finish of each of the other members, such as support members of the gap roller 5, has to be increased and this is very expensive. Furthermore, this apparatus has a shortcoming that non-uniform development and smearing of the background are apt to occur when the recording paper 6 is transported intermittently.

More specifically, if the recording paper 6 is stopped while the toner T is present on the surface of the sleeve 1, a portion of the recording paper 6, which is nearest the toner T, will attract multiple layers of the toner T thereto, so that image density of the portion will become higher than that of the other portions of the recording paper 6. As a result, the image density of the recording paper 6 becomes non-uniform. When the above-mentioned portion of the recording paper 6 happens to be a non-image area, the toner T will deposit on the portion, so that the background of the non-image area is smeared by the toner T.

SUMMARY OF THE INVENTION

It is an object of the invention to provide an improved magnetic brush development apparatus for developing latent electrostatic images formed on a latent electrostatic image bearing member.

Another object of the invention is to provide an improved magnetic brush development apparatus of the above-mentioned type, which does not cause uneven development and smearing of the background of the latent electrostatic image bearing member even if the latent electrostatic image bearing member is transported intermittently in the development apparatus.

A further object of the invention is to provide an improved magnetic brush development apparatus of the same type as mentioned above, in which the gap between the latent electrostatic image bearing member and the development sleeve can be simply maintained.

A development apparatus according to the invention comprises a container for holding a developer comprising a magnetic material therein, a non-magnetic sleeve with an internally disposed magnet, which is disposed in the container, drive means for rotating either the magnet or the sleeve so that the developer attracted to the surface of the sleeve is transported along the surface of the sleeve, a doctor blade for regulating the amount of the developer on the sleeve, guiding and stretching means for bringing a flat stretched portion of a flexible latent electrostatic image bearing member into contact with or in proximity to the surface of the sleeve, and drive means for moving the latent image bearing member, while in contact with or in proximity to the surface of the sleeve, in the same direction as the transport direction of the developer on the surface of the sleeve.

As the developers for use with the development apparatus according to the invention, a two-component type developer comprising magnetic carriers and resin toner and a one-component type developer comprising resin toner containing a magnetic material therein can be exployed equally. The developer attracted to the surface of the sleeve is transported in the rotating direction of the sleeve when the sleeve is rotated and the magnet is maintained stationary. And when the magnet is rotated and the sleeve is maintained stationary, the developer attracted to the surface of the sleeve is transported in the opposite direction to the rotating direction of the magnet. Either a roller-shaped magnet or a block-shaped magnet can be employed as the magnet.

DETAILED DESCRIPTION OF THE PREFERRED EMBODIMENTS

Figure 2:
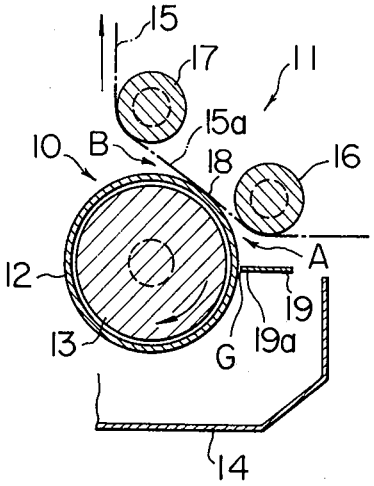
FIG. 2 is a diagrammatical view of an embodiment of a development apparatus of the invention.

Referring to FIG. 2, there is shown an embodiment of a development apparatus according to the invention. In FIG. 2, reference numeral 10 represents a development roller, and reference numeral 11 represents guide means for guiding a latent electrostatic image bearing member. The development roller 10 is made from a non-magnetic material and comprises a stationary sleeve 12 with an internally disposed magnetic roller 13 which is alternately magnetized to negative and positive polarity in the circumferential direction of the stationary sleeve 12 and is rotated clockwise by drive means (not shown).

Under the development roller 10, there is disposed a toner container 14 for holding a one-component type magnetic developer (hereafter referred to as "toner") therein. The toner is attracted magnetically to the surface of the sleeve 12 by the internally disposed magnetic roller 13 and is moved counterclockwise along the surface of the sleeve 12 when the magnetic roller 13 is rotated clockwise. The magnetic roller 13 is rotated continuously, independently of the intermittent transportation of the recording paper which will be described later in detail.

The guide means 11 supplies a tension to a recording paper 15, which is a latent electrostatic image bearing member, and brings the recording paper 15 into contact with the peripheral surface of the sleeve 12. In the present embodiment, the guide means 11 comprises a first roller 16, which is a first guide member, and a second roller 17, which is a second guide member. Each of the two rollers 16, 17 is made of an electrically conductive material and is rotatably disposed.

The first roller 16 and the second roller 17 are disposed in a configuration such that a portion **15*a* of the recording paper 15, which is stretched flat between the two rollers 16, 17, is in contact with part of the peripheral surface of the sleeve 12, so that between the portion 15*a* of the recording paper 15 and the sleeve 12, there are formed two spaces, whose cross sections are wedge-shaped, on the opposite sides of a contact portion 18 where the portion 15*a* and the sleeve 12 contact with each other. In FIG. 2, a wedge-shaped space A is formed upstream of the transport direction of the recording paper 15, and a wedge-shaped space B is formed downstream of the transport direction of the recording paper 15. Under the space A, there is disposed a doctor blade 19 for regulating the amount of the toner on the sleeve 12. One end 19*a* of the doctor blade 19 is in proximity to the surface of the sleeve 12, with a gap G between the end 19*a* and the surface of the sleeve 12. Note that the end 19*a* of the doctor blade 19 is not necessarily flat since the doctor blade 19 serves to control the amount of the developer to be supplied into the space A and it does not necessarily control the height of the magnetic brush. In this embodiment, the recording paper 15** is used in a graphic information reception section of facsimile apparatus and is transported intermittently while latent electrostatic images are being formed thereon by a latent electrostatic image formation means (not shown).

In the above-mentioned development apparatus, principally there are three variations with respect to at least the first roller 16, the doctor blade 19, the toner container 14 and the sleeve 12.

In the first type, at least the first roller 16 is conductive and grounded, the doctor blade 19 is also conductive and grounded, and the toner container 14 and the sleeve 12 are conductive and grounded or insulated.

In the second type, at least the first roller 16 is conductive and grounded, the doctor blade 19 is insulated, the toner container 14 is conductive and grounded, and the sleeve 12 is conductive and grounded or insulated.

In the third type, at least the first roller 16 is conductive and grounded, the sleeve 12 is conductive and grounded, and the doctor blade 19 and the toner container 14 are conductive and grounded or insulated.

The same thing applies to the other embodiments of the invention which will be described later.

The development in the thus constructed development apparatus will now be explained.

Figure 3:
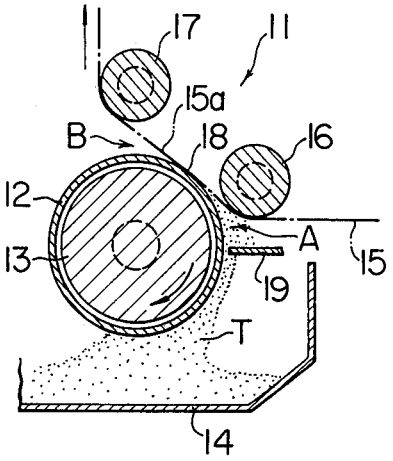
FIG. 3 is a diagrammatical view of the development apparatus of FIG. 2 for explaining its operation specifically.

As shown in FIG. 3, when the magnetic roller 13 is rotated clockwise, toner T placed in the toner container 14 is moved counterclockwise along the surface of the sleeve 12 and is transported into the space A through the gap G. Of the toner T fed into the space A, only a small amount thereof can pass through the contact portion 18, since the recording paper portion 15*a* is in contact with the surface of the sleeve 12. As a result, the toner T accumulates in the space A. When the toner T accumulated in the space A contacts the recording paper 15, the latent electrostatic images formed on the recording paper 15 are developed. In other words, the recording paper 15, independently of its movement, is always in contact with the toner T in the space A. Therefore, the latent electrostatic images on the recording paper 15 which comes to the space A are developed before the recording paper 15 reaches the contact portion 18, and the recording paper 15 stops at the contact portion 18 or moves further beyond the contact portion 18.

Even if the developed recording paper 15 is moved while in contact with the surface of the sleeve 12, the recording paper 15 passes over the contact portion 18 without the formed toner images being damaged, since the toner T is electrostatically attracted to the recording paper 15 at this time. In the contact portion 18, in addition to the electrostatically attracted toner T, a small amount of the toner passes through the contact portion 18, as the recording paper 15 is moved. The small amount of the toner, which passes through the contact portion 18 other than the toner T contributed to the image formation, includes the toner which is moved due to friction by the contact of the recording paper 15 with the sleeve 12 and the toner T which is caused to adhere mechanically to the recording paper 15 by the contact of the recording paper 15 with the sleeve 12. If the toner images are fixed while the small amount of toner deposits and remains in the non-image area of the recording paper, the background is smeared by the toner. However, in the invention, since part of the flat stretched recording paper 15 is in contact with the sleeve 12, the recording paper 15 downstream of the contact portion 18, viewed from the transport direction of the recording paper 15, is moved away from the sleeve 12 as the recording paper 15 is transported. When the recording paper 15 begins to be moved away from the sleeve 12, the toner deposited on the background of the recording paper is attracted back to the surface of the sleeve 12 by the magnetic roller 13. In other words, in the invention, development is performed in one wedge-shaped space A, and cleaning is performed in the other wedge-shaped space B.

The recording paper 15 may be intermittently transported during the formation of latent electrostatic images, and behavior of the toner T in the space A, when the recording paper 15 is stopped, will now be explained.

Figure 1:
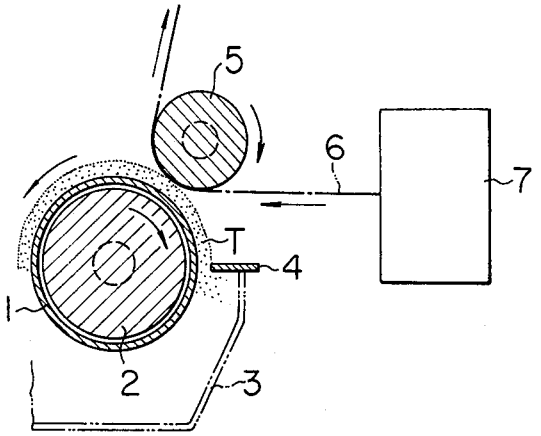
FIG. 1 (PRIOR ART)
FIG. 1 is a diagrammatical view of a conventional magnetic brush development apparatus.

A portion of the recording paper 15 stopping in the space A is in contact with the toner T, and the toner T is electrostatically attracted to the latent images formed on the recording paper 15 while, in the background of the recording paper 15, the toner T is simply in contact therewith. Therefore, external force, such as a force enabling the toner T to move on the surface of the recording paper 15, is not applied to the toner T and the toner that can be attracted to the latent electrostatic images by their charges is attracted to the latent electrostatic images and nothing more, so that even if the recording paper 15 is stopped in contact with the toner T while it is transported intermittently, it could never happen that the image density of the portion in contact with the toner T becomes higher than the image density of the other portions. Namely uneven development does not occur. This is a significant feature of the invention in contrast with the conventional development apparatus as shown in FIG. 1, in which the toner T is supplied to the latent electrostatic image continuously by the movement of the toner, so that the toner T adheres to the latent electrostatic image more than required.

In the above-mentioned embodiment of the invention, since the recording paper 15 is brought into plane contact with the sleeve 12, it is simple to adjust the gaps between the surface of the sleeve 12 and each of the first roller 16 and the second roller 17 for guiding the recording paper 15, and since a requirement is to form the spaces A and B whose cross sections are wedge-shaped, slight shiftings of the two rollers 16, 17 from their predetermined positions would not reduce the development function and the cleaning function. In other words, a high accuracy is not required for making the support means for supporting the two rollers 16, 17, with the result that the apparatus can be made in low cost.

In the above-mentioned embodiment, since the recording paper 15 is moved in contact with the stationary sleeve 12, there may be a risk that cleaning of the background cannot be made completely due to the triboelectric charging by contact of the recording paper 15 with the sleeve 12 and also by the triboelectric charging between the toner particles due to a high toner density of the accumulated toner particles in the space A. This problem can be eliminated by bringing the recording paper 15 into line contact with the surface of the sleeve 12 or by maintaining a small gap between the recording paper 15 and the surface of the sleeve 12.

Figure 4:
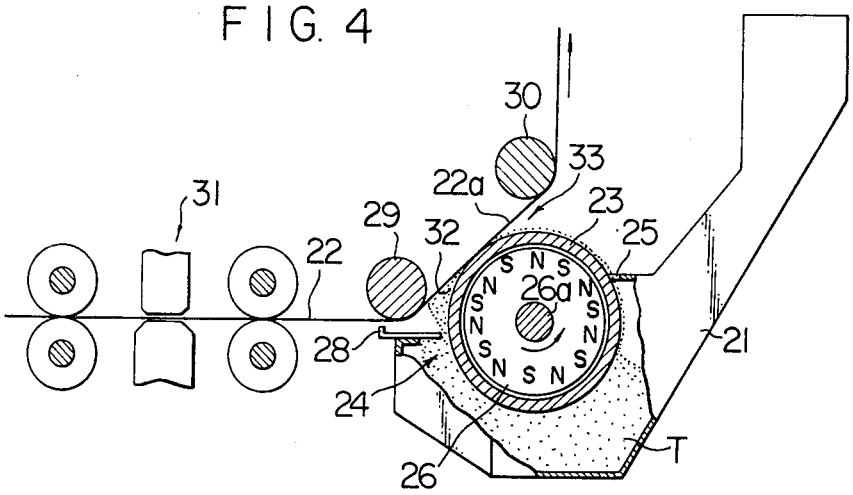
FIG. 4 is a diagrammatical view of another embodiment of a development apparatus of the invention.
Figure 5:
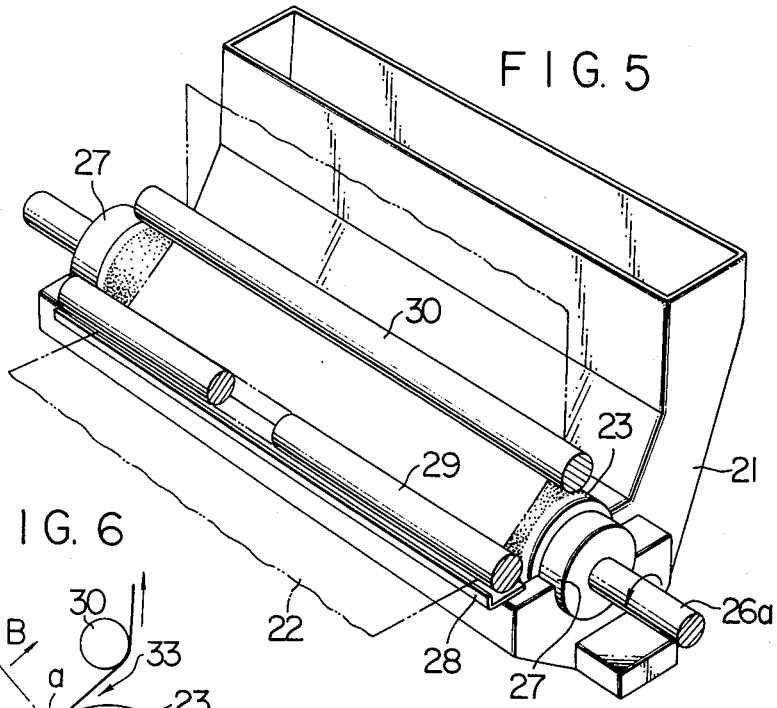
FIG. 5 is a schematic perspective partial view of the development apparatus of FIG. 4.

Referring to FIGS. 4 and 5, there is shown another embodiment of a development apparatus of the invention, in which some measures are taken to eliminate the above-mentioned problem. In FIGS. 4 and 5, reference numeral 21 represents a toner container for holding a one-component type conductive toner T, and reference numeral 22 a recording paper. In the container 21, there is a toner support sleeve 23, made of a non-magnetic material and having a smooth outer surface, in a manner such that part of the peripheral surface of the sleeve 23 is exposed out of the toner container 21. Between the sleeve 23 and the toner container 21, there is a toner feed opening 24 and a toner recovery opening 25 in the axial direction of the sleeve 23.

Inside the sleeve 23, there is a magnetic roller 26 which is alternately magnetized to negative and positive polarity in the peripheral direction thereof. The magnetic roller 26 is supported in the toner container 21 by a pair of bearings 27, and a shaft 26*a* of the magnetic roller 26 is connected to a suitable drive means (not shown) and is rotated in the direction of the arrow with a predetermined number of revolutions. The magnetic roller 26 forms a magnetic field uniformly in the axial direction thereof on the surface of the sleeve 23. As the magnetic roller 26 is rotated in the direction of the arrow, the magnetic field changes its position, whereby the toner T placed in the toner container 21 is moved along the surface of the sleeve 23 in the direction opposite to the rotation of the magnetic roller 26. In other words, the magnetic roller 26 scoops up the toner T in the container 21 out of the opening 24 and returns the toner T into the container 21 through the opening 25 after using it for development which will be described later. At one side edge of the opening 24 of the container 21, there is disposed a doctor blade 28 for regulating the amount of the toner fed from the opening 24 in a manner such that the effective open area of the opening 24 can be varied.

In FIG. 4, there are disposed the first and the second guide roller 29, 30 for stretching and guiding the recording paper 22 on the left side and the upper side of the sleeve 23, respectively. The two guide rollers 29, 30 are positioned in a manner such that a portion 22*a* of the recording paper 22 stretched flat over the two guide rollers 29, 30 is positioned in conformity with a tangent of the sleeve 23 or with a small gap maintained between the flat portion 22*a* and the surface of the sleeve 23. The small gap is set in the range for the magnetic force of the magnetic roller 26 not to become smaller than a predetermined magnetic force.

Electric charges are applied to the recording paper 22 in correspondence with signals received at a plotter section 31 so that latent electrostatic images are formed on the recording paper 22. The latent image surface is caused to pass in line contact with the surface of the sleeve 23 or with the predetermined small gap therebetween. As a result, the spaces 32, 33, whose respective cross sections are wedge-shaped, are formed between the sleeve 23 and the flat portion 22*a* of the recording paper between the first and second guide rollers 29, 30. The toner T scooped out onto the surface of the sleeve 23 by the rotation of the magnetic roller 26 accumulates in the space 32 to form a toner reservoir. The position of the doctor blade 28 is set in a manner such that a sufficient amount of the toner for developing latent electrostatic images is always present. The gap between the top of the doctor blade 28 and the surface of the sleeve 23 is set in a manner such that the toner fed into the space 32 does not increase the toner density in the space 32 too high.

The operation of the development apparatus of the invention will now be explained.

The recording paper 22 having the latent electrostatic images formed at the plotter section 31 is moved as the signal reception operation proceeds, so that the latent electrostatic images are successively brought into contact with the toner in the space 32. The toner in the space 32 adheres to the latent electrostatic images due to the electrostatic attraction thereof. In the space 32 where the toner reservoir is formed, the toner is brought into contact not only with the latent electrostatic image portions but also with the background of the recording paper 22. The toner brought into contact with the background adheres to the background due to the residual charges of the background and triboelectric charging of the toner. Therefore, the toner deposits on the background of the recording paper 22 which has passed through the space 32 and the deposited toner may cause the smearing of the background. However, when the recording paper 22 is moved beyond the contact point between the recording paper and the surface of the sleeve 23 or the small gap portion therebetween (which is represented by reference symbol a in FIG. 6), and reaches the space 33, the toner on the background of the recording paper 22 is attracted back to the surface of the sleeve 23 in the range where the magnetic force of the magnetic roller 26 reaches the toner, since there is not a large amount of the toner in the space 33 as in the space 32. The toner attracted back to the surface of the sleeve 23 is returned into the toner container 21 through the opening 25.

In the meantime, the toner is replenished through the opening 24 whose effective open area is regulated by the doctor blade 28, to the space 32 by the amount equal to the amount of the toner that has been moved from the space 32 to the space 33 by the development of latent electrostatic images, deposition of the toner on the background of the recording paper 22 and the movement of the recording paper 22. In other words, since the recording paper 22 is moved in line contact with the surface of the sleeve 23 or with a small gap maintained between the recording paper and the surface of the sleeve 23, the toner fed into the space 32 is slightly moved along the surface of the sleeve 23 into the space 33. Therefore, the toner does not stay with a high density in the space 32 and triboelectric charging of the toner particles is considerably held back. If the toner is held under the condition of high toner density, triboelectric charging becomes apt to occur between the toner and the recording paper. This is prevented in this embodiment. Therefore, in the space 33, the amount of the toner deposited on the background of the recording paper is extremely small, and the adhesion of the toner to the background is so weak that the toner can be completely removed from the background by the magnetic force of the magnetic roller 26 and the background can be cleaned flawlessly.

Figure 6:
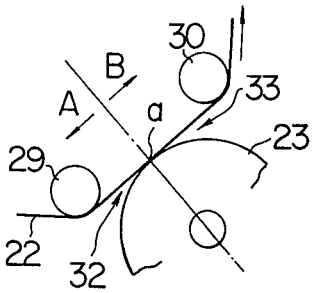
FIG. 6 is a diagrammatical view of the development apparatus of FIG. 4 for explaining its operation specifically.

In other words, the spaces 32, 33, which are formed on the opposite sides of the point a in FIG. 6, are used as a development section A and a cleaning section B, respectively. In the development section A, a necessary amount of the toner for development is supplied to the recording paper 22. If the excess of the toner deposits on the latent electrostatic images, the excessively deposited toner is removed in the cleaning section B. The toner images on the recording paper 22, which has passed through the development section A and the cleaning section B, are clear and well reproduced, with all the adverse effects on the toner images such as fog of the background, being removed. The recording paper 22 can be set in line contact with the sleeve 23 or with a small gap maintained between the recording paper 22 and the surface of the sleeve 23. In the latter case, it is only required that the gap be set in the range within the reach of the magnetic force of the magnetic roller 26. Therefore, in either case, a high accuracy is not required to the production of a mechanism for the registration of the guide rollers 29, 30. This is one of the advantages of the present apparatus over the conventional apparatus.

In the embodiment in FIG. 4 to FIG. 6, a good image was obtained under the following conditions: The surface potential of the recording paper 22 was set in the range from −80 to 150 volts. The magnetic flux density on the surface of the sleeve 23 was set in the range from 300 to 1200 Gauss by use of the magnetic roller 26 having eight magnetic poles. The rotation speed of the magnetic roller 26 was set in the range from 80 to 140 rpm. The gap between the doctor blade 28 and the surface of the sleeve 23 was set in the range from 0.2 to 0.5 mm. The particle size of the conductive toner was in the range of 10 to 30$\mu$ and the resisitivity of the toner was in the range from $3\times10^3$ Ωcm to $8\times10^3$ Ωcm. The gap between the recording paper 22 and the sleeve 23 was set in the range from 0 (zero) to 0.8 mm. The good image here means an image with the image density in the range from 1.2 to 1.5 and with the background density in the range from 0.06 to 0.1.

In this embodiment, since the recording paper 22 and the toner support sleeve 23 are positioned in line contact with each other or with a small gap maintained therebetween, triboelectric charging by contact of the recording paper 22 with the sleeve 23 does not take place, and since the toner in the space 32 is moved gradually into the space 33 on the downstream side of the space 32, viewed from the transport direction of the recording paper 22, the toner does not stay in the space 33 with a high toner density, so that triboelectric chargings between the toner particles and between the toner and the recording paper do not occur. Namely, by avoiding that the recording paper 22 comes into plane contact with the surface of the sleeve 23 and by moving a small amount of the toner into the wedge-shaped space 33 on the downstream side, trioelectric charging of the recording paper 22 and the toner particles that might otherwise occur is prevented, so that the toner deposited on the background of the recording paper 22 can be completely removed and the formation of floating carbon particles, which are removed from the toner particles by the friction of the toner particles against each toner. Deterioration of the charging characteristics of the toner can be prevented.

In this embodiment, the sleeve can be made of an electrically conductive material. In each of the embodiment of the invention, the sleeve is set stationary, while the magnetic roller is rotated in order to scoop up the toner onto the toner support sleeve. However, the magnetic roller can be set stationary while the sleeve and the magnetic roller are moved in the same direction. Furthermore, in the invention, a two-component type developer comprising resin toner and magnetic carriers can be employed instead of the one-component type developer. As the means for guiding and stretching the latent image bearing member, a stationary member can be employed instead of the first and second rollers. The outer surface of the sleeve can be covered with a material having a small coefficient of friction so as to reduce the friction between the latent image bearing member and the surface of the sleeve.

While the specific embodiments of the invention applied to a recording section of the facsimile apparatus have been shown in detail to illustrate the application of the principles of the invention, it will be understood that the invention may be embodied otherwise without departing from such principles.

What is claimed is:

1. An apparatus for developing electrostatic latent images formed on an image bearing member movable past a development zone, including a container for holding a supply of magnetically attractible developer, and developing means for transporting said developer from said container to said development zone and forming with said image bearing member a space for accumulating developer held in contact with said member, said developer accumulating in said space being movable relative said image bearing member by movement of said member whereby the amount of developer brought into contact with said image bearing member will depend upon the movement of said member through said development zone, said means including a non-magnetic sleeve engaging developer in said container and located adjacent said development zone, a magnetized device disposed within said sleeve and drive means for providing relative movement between said magnetized device and said sleeve.

2. An apparatus according to claim 1, said developing means further forming with said image bearing member a second space located downstream of said first mentioned space in the direction of movement of said image bearing member for accumulating developer held in contact with said member for cleaning background portions of the electrostatic latent image carried by said member.

3. An apparatus according to claims 1 or 2, said developing means including a doctor blade regulating the amount of developer transported by said sleeve into said first mentioned space.

4. An apparatus according to claim 3, said container and sleeve being conductive and grounded, or insulated, said doctor blade being conductive and grounded, and means supporting said image bearing member being conductive and grounded.

5. An apparatus according to claim 3, said container being conductive and grounded, said sleeve being conductive and grounded, or insulated, said doctor blade being insulated and means supporting said image bearing member being conductive and grounded.

6. An apparatus according to claim 3, said container being conductive and grounded, or insulated, said sleeve being conductive and grounded said doctor blade being conductive and grounded, or insulated, and means supporting said image bearing member being conductive and grounded.

7. An apparatus according to claim 1 or 2, said image bearing member being generally planar while passing through said development zone.

8. An apparatus according to claim 7, said image bearing member being flexible and held taut while passing through said development zone.

9. An apparatus according to claim 8, said image bearing member being held in contact with said sleeve.

10. An apparatus according to claim 9, said image bearing member being in line contact with said sleeve.

11. An apparatus according to claim 8, said image bearing member being spaced a small distance from said sleeve.

12. An apparatus according to claim 1 or 2, the surface of said sleeve being smooth.

13. An apparatus according to claim 1 or 2, said image bearing member moving in the same direction as said developer transported into said development zone.

14. An apparatus according to claim 13, said magnetized device being magnetized along the peripheral surface thereof and rotated while holding said sleeve stationary to transport said developer.

15. An apparatus according to claim 1 or 2, said developer being one-component type magnetic developer.

* * * * *